US007086527B2

(12) United States Patent
Möck

(10) Patent No.: US 7,086,527 B2
(45) Date of Patent: Aug. 8, 2006

(54) RECEPTACLE FOR ACCOMMODATING AT LEAST ONE PENCIL

(75) Inventor: Gerhard Möck, Kirchehrenbach (DE)

(73) Assignee: Schwan-STABILO Schwanhausser GmbH & Co. KG, Heroldsberg (DE)

( * ) Notice: Subject to any disclaimer, the term of this patent is extended or adjusted under 35 U.S.C. 154(b) by 0 days.

(21) Appl. No.: 10/508,981

(22) PCT Filed: Jun. 18, 2003

(86) PCT No.: PCT/EP03/06480

§ 371 (c)(1),
(2), (4) Date: Sep. 24, 2004

(87) PCT Pub. No.: WO04/000064

PCT Pub. Date: Dec. 31, 2003

(65) Prior Publication Data

US 2005/0126934 A1 Jun. 16, 2005

(30) Foreign Application Priority Data

Jun. 25, 2002 (DE) ..... 102 28 316

(51) Int. Cl.
*A45C 11/34* (2006.01)

(52) U.S. Cl. ..... 206/214; 206/371

(58) Field of Classification Search ..... 206/214, 206/222, 371, 443; 229/5.5, 5.6, 198.2, 930, 229/117

See application file for complete search history.

(56) References Cited

U.S. PATENT DOCUMENTS

| | | | | |
|---|---|---|---|---|
| 557,371 | A * | 3/1896 | Ferguson | 229/120.04 |
| 2,412,938 | A * | 12/1946 | Amoth | 206/371 |
| RE23,102 | E * | 4/1949 | Baker | 229/5.5 |
| 2,726,803 | A * | 12/1955 | Ketler | 229/5.5 |
| 3,272,421 | A * | 9/1966 | Perry | 229/185 |
| 4,648,505 | A | 3/1987 | Belmondo | |
| 5,316,141 | A * | 5/1994 | Jalomo | 206/320 |
| 5,893,458 | A * | 4/1999 | Sisk | 206/396 |
| 5,950,814 | A * | 9/1999 | Lindberg et al. | 206/6 |
| 6,425,626 | B1 * | 7/2002 | Kloepfer | 229/149 |

FOREIGN PATENT DOCUMENTS

| | | |
|---|---|---|
| EP | 0 823 227 | 2/1998 |
| GB | 859819 | 1/1961 |

* cited by examiner

*Primary Examiner*—Luan K. Bui
(74) *Attorney, Agent, or Firm*—Bachman & LaPointe, P.C.

(57) ABSTRACT

A receptacle for accommodating at least one pencil, comprising an inner space and a first wall element that delimits the inner space. The first wall element has a first connecting section that is located inside the inner space, and at the free end of this connecting section, an end section is to be folded back onto a second element that is adjacent to the first connecting section.

9 Claims, 4 Drawing Sheets

RECEPTACLE FOR ACCOMMODATING AT LEAST ONE PENCIL

BACKGROUND OF THE INVENTION

The invention concerns a receptacle for accommodating at least one pencil, comprising an internal space and a first wall element forming a boundary of the internal space.

Receptacles of the above-indicated kind are known. They generally have peripherally extending edges of at least two millimeters in width, along which individual parts of the receptacle are welded, the individual parts usually involving a cover and a bottom. As the edges are sometimes comparatively sharp, they cause problems when handling the receptacle and even involve a risk of injury. In addition they are not very attractive from aesthetic points of view.

The object of the invention is to develop the receptacle of the kind set forth in the opening part of this specification, in such a way that handling of the receptacle is improved, any risk of injury is eliminated and the receptacle is aesthetically attractive.

SUMMARY OF THE INVENTION

According to the invention the foregoing object is attained wherein a first wall element has a first connecting portion which is in the internal space and at the free end of which an end portion is bent over towards a second wall element which is adjacent to the first connecting portion.

In other words in accordance with the invention there are provided two matters for attaining the specified object: on the one hand an edge which is at the free end of the end portion of the first connecting portion is arranged within the internal space of the receptacle. As a result, at least when the receptacle is closed, the edge does not interfere either with handling or the aesthetic effect. Any risk of injury is also eliminated, when the container is closed. Secondly however it is also provided in accordance with the invention that the free end of said end portion or the edge does not project for example into the internal space but is bent over on to the second wall element. The consequence of that arrangement of the edge is that the edge cannot cause any interference in any fashion. More specifically, as it is towards the adjacent wall element, it does not adversely affect handling of the receptacle, for example when removing a pencil. In addition, alignment of the edge with the adjacent wall element excludes a risk of injury because a user cannot come into contact with the edge at all. Finally, the fact that the edge is 'concealed' provides an improvement in the aesthetic aspect.

It should be expressly pointed out at this juncture that 'bent over' is intended to embrace any conceivable kind of deflection, in particular 'folding down'.

In accordance with a preferred embodiment of the invention it is provided that the first connecting portion forms with the second wall element a gap which is delimited by the end portion.

In other words, this configuration provides that an edge which in fact in principle involves in particular a risk of injury forms the end of a gap and is thus arranged to be inaccessible for the fingers of a user. That obviates any risk of injury. In that way moreover the edge which under some circumstances is aesthetically not very attractive is 'concealed' in the gap.

In a further preferred feature there is provided a connecting device for connecting the first connecting portion to the second wall element.

In this embodiment the first and second wall elements serve to 'hold together' the receptacle, wherein—as discussed in detail hereinbefore—any edges present on end portions are arranged in such a way that they do not interfere with handling, they do not involve any risk of injury and they do not have a disadvantageous effect on aesthetics.

In accordance with the invention the connecting device is preferably a weld. Therefore it is possible for the two wall elements to be connected together in a manner which is particularly simple and which can be automated.

In accordance with a particularly preferred embodiment of the invention, that which has been described hereinbefore in relation to the first wall element also applies to the second wall element. More specifically, in accordance therewith it is provided that the second wall element has a second connecting portion which is in the internal space of the receptacle.

In this configuration of the invention, the same advantages are achieved as is the case with the first connecting portion, in regard to any edges of the second connecting portion.

It will be appreciated that it can also be provided in this configuration of the invention that, at a free end of the second connecting portion, an end portion is bent over towards the first wall element. Once again the same advantages are achieved as are discussed hereinbefore.

In accordance with a particularly preferred embodiment of the invention the first and second wall elements are formed in one piece with each other.

In that respect, for the purposes of assembly of the receptacle, the two wall elements are 'folded' towards each other. Overall, that makes it possible to achieve a minimisation in respect of connecting devices because in fact the two wall elements are already connected together on one side.

In accordance with a preferred embodiment of the invention at least one wall element is formed by a foil or sheet, further preferably by a deep drawing foil.

That configuration simplifies manufacture.

It will be appreciated that the wall thickness of the wall elements can in principle be of any value. It depends on the respective specific requirements involved. Preferably it is between 200 and 400 μm.

Equally the material of the wall elements can in principle be any material. In regard to simplifying the manufacturing process and in regard to pricing, it is provided in accordance with an embodiment of the invention that at least one wall element is of plastic material, preferably thermoplastic or thermosetting plastic material, further preferably PET or PVC.

Particularly when one of the wall elements or all wall elements are produced by deep drawing, subsequent stamping out of a 'cutting pattern' for the receptacle may be required. In addition however it is also possible to conceive of a stamping operation or a cutting operation, within the context of other manufacturing processes.

Therefore in accordance with a particularly preferred embodiment of the invention it is provided that a boundary edge produced by a severing operation such as for example stamping or cutting is disposed at the free end of the first connecting portion.

In other words, in accordance with this configuration of the invention, in particular a stamped or cut edge forming a particularly high risk of injury is 'concealed' by bending over towards the adjacent wall element, thereby achieving the advantages described hereinbefore.

Particularly in this configuration with wall elements which are formed in one piece with each other, the invention provides at least one bending hinge for connecting adjacent wall elements.

Such a bending hinge simplifies further processing for example of a 'cutting pattern' to afford the three-dimensional pencil receptacle because the bending hinge simplifies bending over the wall elements to afford the desired three-dimensional shape.

In order to impart stability to the receptacle, a particularly preferred embodiment of the invention provides at least one stiffening rib which is further preferably in the shape of a bay configuration. Such a bay configuration is more specifically particularly easy to produce in particular in the context of a deep drawing process. In contrast to the provision of a stiffening rib by a corresponding increase in wall thickness, the design afforded by a bay configuration also saves on material.

In order to be able to arrange a plurality of pencils in the receptacle in a space-saving manner in accordance with the invention there is provided an intermediate partition.

In that case, in accordance with the invention, the intermediate partition is preferably made in one piece with the wall elements.

In other words the invention—as also in the other configurations—even in the case of a design configuration with a partition, provides a one-piece 'cutting pattern' from which a three-dimensional receptacle is afforded by a procedure involving bending over or folding and connecting of connecting portions. In particular in that way it is possible to automate the manufacturing process.

BRIEF DESCRIPTION OF THE DRAWINGS

Finally the invention provides preferably at least one latching device for at least temporarily connecting two wall elements to each other. Such a latching device can be provided additionally or alternatively to the connecting device, in particular the welding. In particular it can serve for temporarily holding together two wall elements which are to be welded together, and this simplifies the welding operation.

The invention is described in greater detail hereinafter with further features by means of a preferred embodiment with reference to the accompanying drawing in which.

DETAILED DESCRIPTION

Figure 1:
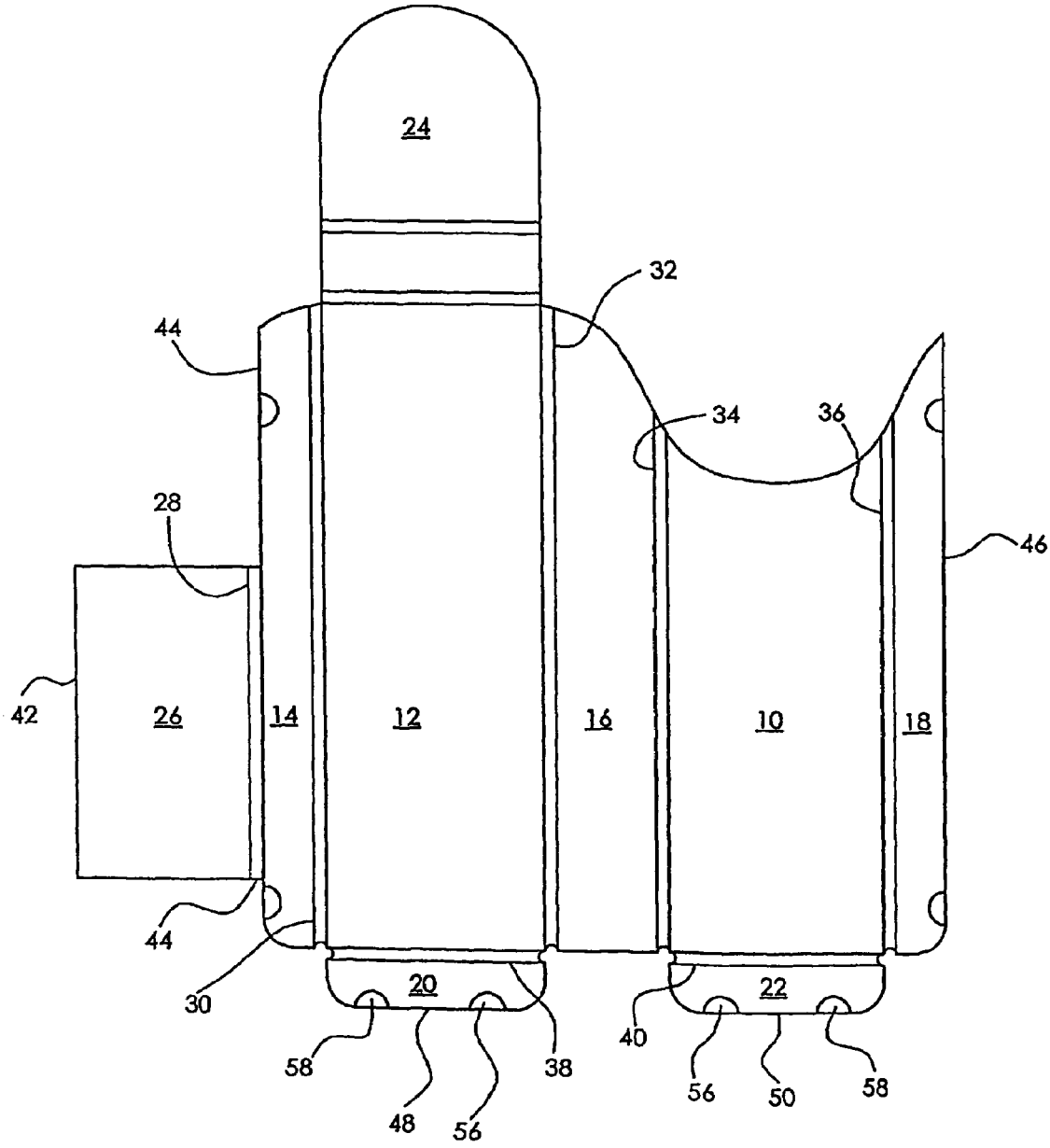
FIG. 1 shows a cutting pattern or development of a particularly preferred embodiment of the receptacle according to the invention.

In accordance with the development, shown in FIG. 1, of the receptacle in accordance with a particularly preferred embodiment of the invention, the following elements are provided:

- a front wall 10, a rear wall 12, side elements 14, 16, 18, 20 and 22, a closure flap 24 and an intermediate partition 26.

Figure 2:
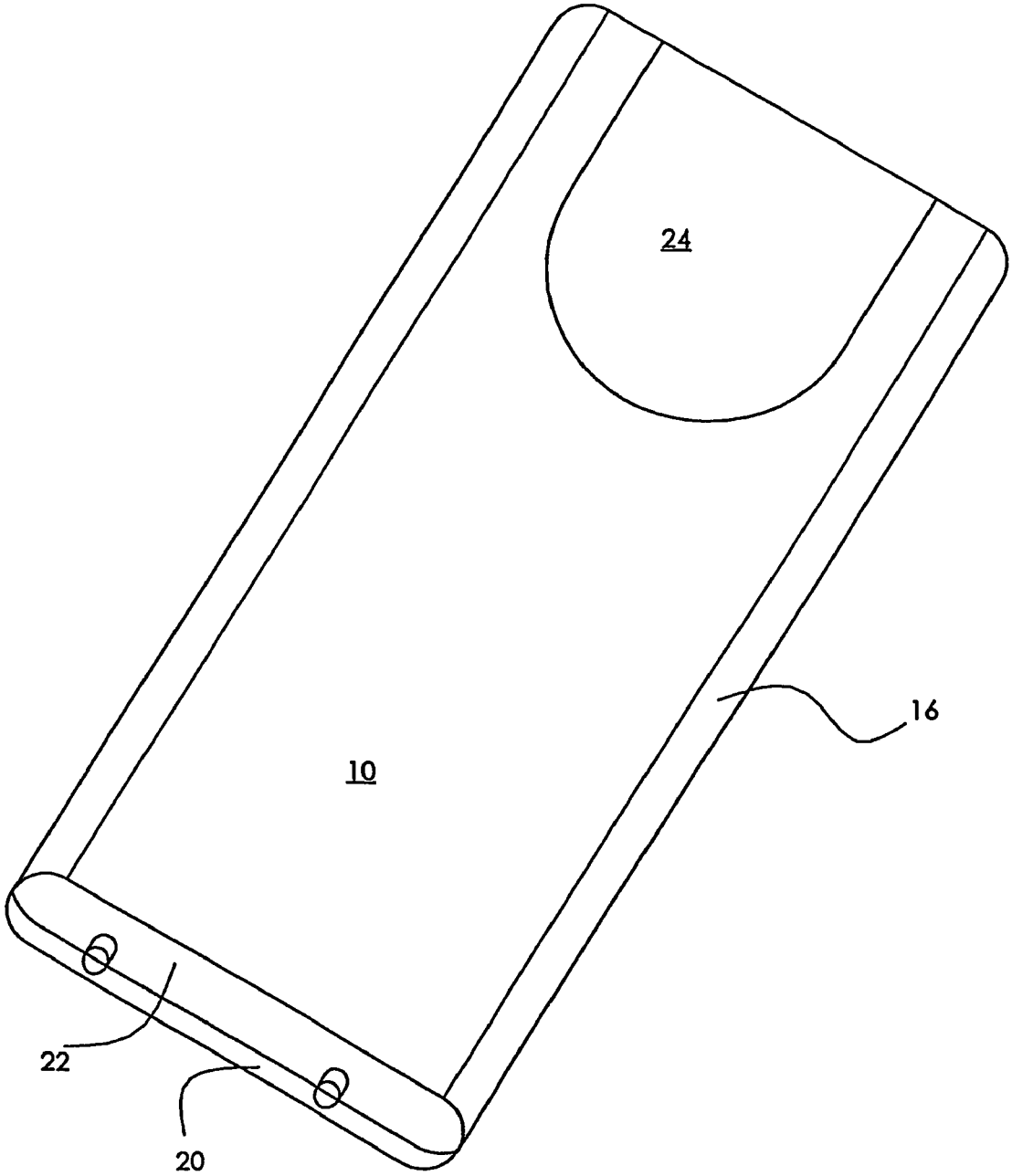
FIG. 2 shows a diagrammatic perspective view of the receptacle of FIG. 1.

The above-specified elements are all formed in one piece with each other, more specifically by deep drawing a PET foil or sheet of a wall thickness of 250 μm. Provided between the specified individual elements are respective bending hinges 28, 30, 32, 34, 36, 38 and 40, whereby 'folding' to assemble the receptacle as shown in FIG. 2 is simplified. The bending hinges are each in the shape of a bay configuration produced in the course of the deep drawing operation, as is shown in section in FIG. 3.

After the deep drawing operation which is performed on webs of foil, the individual receptacle cutting patterns are separated from the respectively preceding and following ones by stamping. In addition, a stamping operation is also effected at lateral boundaries. The stamped edges which are produced as a result are identified by references 42, 44, 46, 48 and 50.

Figure 3:
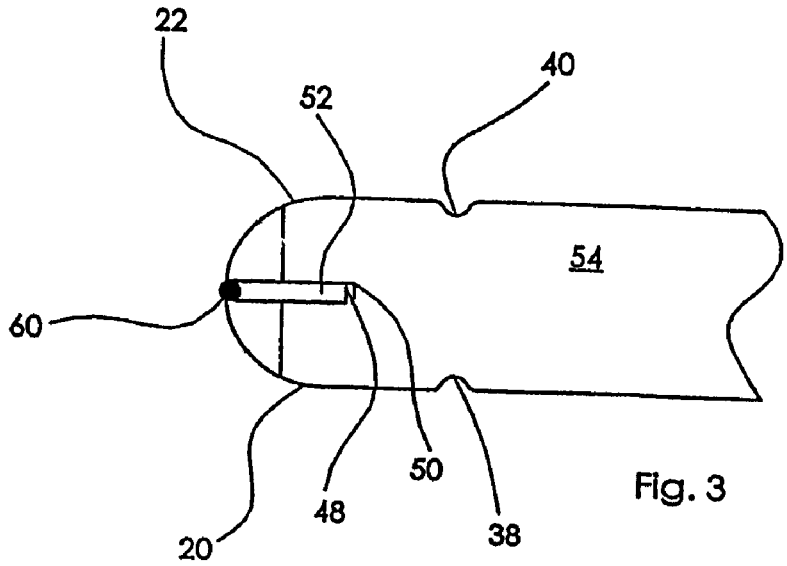
FIG. 3 shows a diagrammatic sectional view of a detail of the receptacle of FIG. 1.

FIG. 3 diagrammatically shows how the stamped edges 48 and 50 are 'concealed' in accordance with the illustrated embodiment of the invention. As can be seen more specifically from FIG. 3 the side elements 20 and 22, starting from the bending hinges 38 and 40 respectively, are firstly arranged to converge towards each other, in which case they subsequently form with each other a gap 52 which is delimited by the stamped edges 48 and 50 which form a first connecting portion.

As a result of that arrangement the stamped edges 48 and 50 on the one hand come to lie in an internal space 54 of the receptacle, whereby they are not visible from the outside and therefore do not interfere with the overall aesthetic impression. In addition the stamped edges 48 and 50 also do not involve any risk of injury because they are each bent over towards the respective adjacent side element.

FIG. 3 diagrammatically shows only the connection of the two side elements 20 and 22 to each other. It will be appreciated that the same also applies for the connection of the side elements 14 and 18 to each other. It will be noted that in the region of the intermediate partition 26 the gap formed there is delimited by the stamped edge 46 and the intermediate partition 26 because there is no corresponding stamped edge present in that region on the intermediate partition 42.

Figure 4:
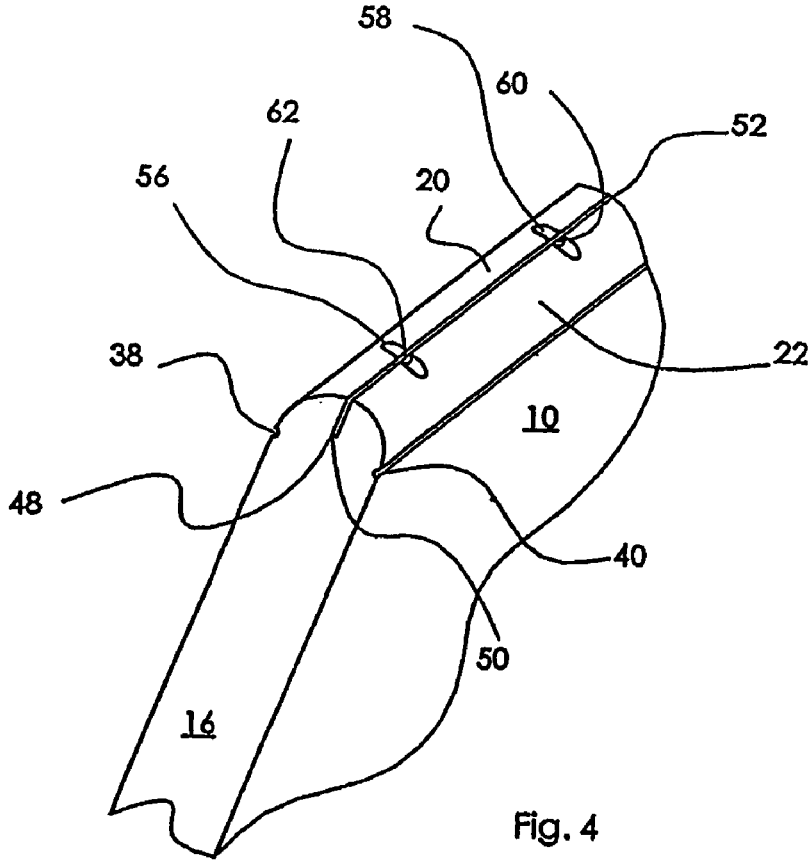
FIG. 4 shows a diagrammatic perspective detail view of the receptacle of FIG. 1, and FIG. 5 diagrammatically shows a latching device of the receptacle of FIG. 1.

FIG. 4 diagrammatically shows stiffening means 56 and 58 which—approximately comparably to the bending hinges—are in the form of bay configurations. Welds 60 and 62 joining the wall elements involved together are provided in the stiffening means. In that way the welds 60 and 62 are also virtually 'concealed' so that they do not adversely affect the overall aesthetic impression. Viewed from the internal space 54 the stiffening bay configurations are in the shape of ribs.

Figure 5:
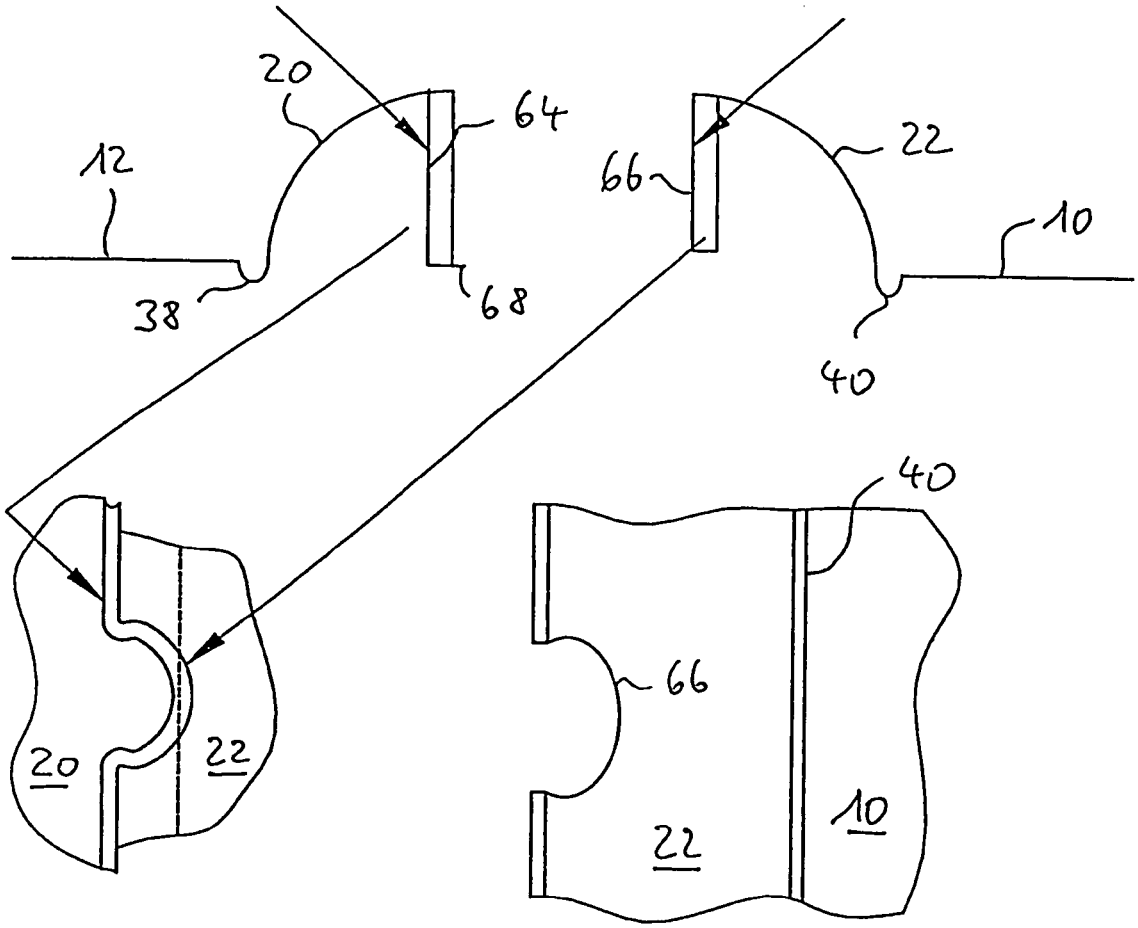

FIG. 5 diagrammatically shows a latching device which is composed in particular of projections 64, 66 and 68. As shown in FIG. 5 the projection 64 is somewhat shorter than the projection 68 and at its free end has a further projection 68 which in the latched condition engages behind the projection 66. The projection 64 corresponds to an outwardly disposed latching groove whereas the projection 66 corresponds to an inwardly disposed latching groove.

Although this is not shown the projections can each be arranged for example between the stiffening means 56 and 58 on the side elements 20 and 22 respectively.

They serve to connect the two side elements 20 and 22 together at least until the welds 60 and 62 have been formed. That manner of temporarily connecting the side elements 20 and 22 together considerably simplifies the welding operation.

The features of the invention which are disclosed in the foregoing description, the claims and the drawing can be essential both individually and also in any combinations for implementing the invention in its various embodiments.

The invention claimed is:

1. A receptacle for accommodating at least one pencil comprising a plurality of wall elements defining an internal space, a first wall element having a first connecting portion and a first end portion within the internal space, a second wall element having a second connecting portion and a second end portion within the internal space, wherein the first end portion is bent over toward the second connecting portion and the second end portion is bent over toward the first connection portion, so that the first and second connecting portions define with the bent over first and second end portions a gap having a closed bottom formed by the bent over first and second end portions, a connecting device comprising a weld bead located at least in part within the gap for connecting the first connecting portion to the second connecting portion, and wherein the first and second wall elements are provided with at least one stiffening rib defining a portion of the gap and the weld bead is adjacent to the stiffening rib.

2. A receptacle as set forth in claim 1, wherein at least one wall element is formed of foil.

3. A receptacle as set forth in claim 2, wherein the foil is a deep drawing foil.

4. A receptacle as set forth in claim 1, wherein the first and the second wall elements have a wall thickness of between 200 and 400 μm.

5. A receptacle as set forth in claim 1, wherein one wall element is formed of a plastic material.

6. A receptacle as set forth in claim 5, wherein the plastic material is PET or PVC.

7. A receptacle as set forth in claim 1, wherein the first and second wall elements are provided with at least one bending hinge.

8. A receptacle as set forth in claim 1, wherein at least one stiffening rib is formed of a bay configuration.

9. A receptacle as set forth in claim 1, further including at least one latching device for at least temporarily connecting the first and second wall elements together.

* * * * *